US008684759B2

(12) United States Patent
Adachi et al.

(10) Patent No.: US 8,684,759 B2
(45) Date of Patent: Apr. 1, 2014

(54) TERMINAL CONNECTION STRUCTURE

(75) Inventors: Hideomi Adachi, Kosai (JP); Hidehiko Kuboshima, Kosai (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 13/876,074

(22) PCT Filed: Sep. 29, 2011

(86) PCT No.: PCT/JP2011/072456

§ 371 (c)(1),
(2), (4) Date: Mar. 26, 2013

(87) PCT Pub. No.: WO2012/043759

PCT Pub. Date: Apr. 5, 2012

(65) Prior Publication Data

US 2013/0196545 A1 Aug. 1, 2013

(30) Foreign Application Priority Data

Oct. 1, 2010 (JP) ..... 2010-223680

(51) Int. Cl.
*H01R 13/15* (2006.01)

(52) U.S. Cl.
USPC ..... 439/262

(58) Field of Classification Search
USPC ..... 439/262, 259
See application file for complete search history.

(56) References Cited

U.S. PATENT DOCUMENTS

| | | | | |
|---|---|---|---|---|
| 1,917,009 | A * | 7/1933 | Betts et al. | 439/262 |
| 3,941,446 | A * | 3/1976 | Cantwell | 439/262 |
| 8,182,278 | B2 * | 5/2012 | Kataoka et al. | 439/266 |
| 8,226,429 | B2 * | 7/2012 | Umetsu et al. | 439/262 |

FOREIGN PATENT DOCUMENTS

| | | | |
|---|---|---|---|
| JP | 7-263080 | A | 10/1995 |
| JP | 2004-327184 | A | 11/2004 |
| JP | 2007-234322 | A | 9/2007 |
| JP | 2009-283391 | A | 12/2009 |

OTHER PUBLICATIONS

International Search Report for PCT/JP2011/072456 dated Dec. 27, 2011, English Translation.

* cited by examiner

*Primary Examiner* — Phuong Dinh
(74) *Attorney, Agent, or Firm* — Sughrue Mion, PLLC

(57) ABSTRACT

A terminal connection structure which is downsized and easily connects terminal fixtures together without producing variation in electric resistance therebetween. The terminal connection structure connects a bus bar connected to an inverter and a second terminal fixture connected to a motor coil. The terminal connection structure includes a first housing receiving a thin-walled portion of the bus bar, a second housing receiving an electric-contact portion of the second terminal fixture and having an insert portion, a clip terminal arranged to make the thin-walled portion closely contact with the electric-contact portion, and a permitting/restricting portion, which permits the clip terminal to be attached to one of the first housing and the second housing when the insert portion is at a predetermined position and restricts the clip terminal from being attached to one of the first housing and the second housing when the insert portion is not at the predetermined position.

3 Claims, 9 Drawing Sheets

TERMINAL CONNECTION STRUCTURE

TECHNICAL FIELD

The present invention relates to a terminal connection structure for connecting terminal fixtures to each other. Specifically, the present invention relates to a terminal connection structure for connecting power source devices to which voltage for driving an automobile is applied.

BACKGROUND ART

Currently, a hybrid vehicle and an electric vehicle which are driven by the rotational drive force of a motor have been used for the reduction in environmental burdens. These types of automobile, i.e. a hybrid vehicle and an electric vehicle and such driven by the rotational drive force of a motor, are mounted with power source devices such as a battery, an inverter, a motor and a generator to which drive voltage is applied. Due to the large voltage value of the electric current flowing between these power source devices, a thick cable which is thicker than an electric wire of a wire harness used for transmitting signal or distributing power to the respective electric equipments is used to connect the above-described power source devices to each other. Conventionally, various terminal connection structures (refer to Patent Literature 1, for example) have been used to connect these thick cables to the above-described power source devices.

A terminal connection structure shown in Patent Literature 1 includes a plurality of strip-shaped terminal fixtures, an insulating housing arranged to receive the terminal fixtures, and a shield shell arranged to cover the outside of the housing and fixed on a case of the power source device and such. The terminal fixture is made of a thick metal plate and is connected to the above-described power source device. The terminal fixture is placed onto another terminal fixture attached to an end of the cable and sandwiched by a bolt and a nut to be connected to the another terminal fixture. The housing is arranged such that the plurality of terminal fixtures lies in the same plane with respect to each other to maintain a lateral distance between the plurality of terminal fixtures as well as to facilitate the engagement of the bolt and the nut. The housing is provided on an outer periphery of the above-described power source device.

The above-described terminal connection structure is arranged to connect the cable with the power source device by threadably engaging the bolt with the nut together so as to sandwich the terminal fixtures overlapped each other between the bolt and the nut. However, the conventional terminal connection structure described above has a drawback that, since the housing is arranged such that the plurality of terminal fixtures lie in the same plane with respect to each other, the width of the housing becomes large, increasing the size of the housing. Obviously, the above-mentioned terminal block is required to be connected with the terminal at the end of the cable such that the electric resistance between the terminal block and the terminal of the cable is less than the desired resistance value. Therefore, the applicant of the present invention has proposed a terminal connection structure 100 (shown in FIG. 13) which is downsized and which can connect terminal fixtures together in a reliable manner.

The terminal connection structure 100 shown in FIG. 13 includes a first terminal fixture 102 connected to a coil 101 of a motor, a second terminal fixture 103 connected to an inverter, and a clip terminal 104. The first terminal fixture 102 and the second terminal fixture 103 are provided with electric-contact portions 105, 106 formed respectively into a strip-like shape to be overlapped each other. The clip terminal 104 includes a pair of contact pieces arranged to sandwich the electric-contact portions 105, 106 overlapped each other and a biasing joint portion formed continuously from the pair of contact pieces and arranged to bias the pair of contact pieces sandwiching the electric-contact portions 105, 106 towards each other. The clip terminal 104 is arranged to move closer to these electric-contact portions 105, 106 along a direction perpendicular to a longitudinal direction of the electric-contact portions 105, 106 overlapped each other to sandwich the electric-contact portions 105, 106 overlapped each other between the pair of contact pieces.

The terminal connection structure 100 shown in FIG. 13 is arranged to connect the electric-contact portions 105, 106 together by moving the clip terminal 104 towards the electric-contact portions 105, 106 along a direction perpendicular to (i.e. intersecting) the longitudinal direction of the electric-contact portions 105, 106 of the first and the second terminal fixtures 102, 103 overlapped each other, followed by sandwiching the electric-contact portions 105, 106 between the pair of contact pieces of the clip terminal 104. Thus, even if the electric-contact portions 105, 106 of the first and the second terminal fixtures 102, 103 are arranged in parallel at an interval between each other, the electric-contact portions 105, 106 can be connected to each other in a reliable manner. Thus, by positioning the electric-contact portions 105, 106 of the first and the second terminal fixtures 102, 103 in parallel at an interval between each other, the width of the terminal connection structure 100 can be decreased compared to the case in which the electric-contact portions 105, 106 of the first and the second terminal fixtures 102, 103 are arranged to lie in the same plane. Thus, the terminal connection structure 100 can be downsized.

Furthermore, since the clip terminal 104 includes the pair of contact pieces and the biasing joint portion arranged to bias the pair of contact pieces toward each other, the clip terminal 104 sandwiches the electric-contact portions 105, 106 overlapped each other between the pair of contact pieces, thereby electrically-connecting the first terminal fixture 102 and the second terminal fixture 103 to each other in a reliable manner. Thus, the terminal fixtures 102, 103 can be connected to each other in a reliable manner.

CITATION LIST

Patent Literature

Patent Literature 1: Japan Patent Application Publication No. 2004-327184

SUMMARY OF INVENTION

Technical Problem

However, the above-described terminal connection structure 100 shown in FIG. 13 has a drawback that, since the attachment of the clip terminal 104 is possible when the electric-contact portions 105, 106 of the terminal fixtures 102, 103 are overlapped to each other, the clip terminal 104 may connect the electric-contact portions 105, 106 of the terminal fixture s 102, 103 even when the relative position of the electric-contact portions 105, 106 of the terminal fixtures 102, 103 are not in a desired predetermined position. This causes the variation in overlapping areas of the electric-contact portions 105, 106 of the terminal fixtures 102, 103, thus causing the variation in the electric resistance between the terminal fixtures 102, 103 or causing an increase in man-hour for an assembling needed to correct the relative position of the electric-contact portions 105, 106 of the terminal fixtures 102, 103 to be in the predetermined position.

Therefore, an object of the present invention is to provide a terminal connection structure which is downsized and which can facilitate the connection of terminal fixtures to each other without producing the variation in the electric resistance between the terminal fixtures.

Solution to Problem

In order to solve the above-described problem and achieve the object, the present invention provides, in a first aspect, a terminal connection structure for connecting an electric-contact portion of a first terminal fixture connected to a power source device with an electric-contact portion of a second terminal fixture connected to another power source device, the terminal connection structure including, a first housing arranged to receive the electric-contact portion of the first terminal fixture, a second housing arranged to receive the electric-contact portion of the second terminal fixture and having an insert portion to be inserted into the first housing, a clip terminal which is moved towards the second housing with the insert portion being inserted into the first housing along a direction intersecting the electric-contact portion of the first terminal fixture and the electric-contact portion of the second terminal fixture overlapped each other, by which the clip terminal is attached to one of the first housing and the second housing while the electric-contact portion of the first terminal fixture and the electric-contact portion of the second terminal fixture being closely contacted to each other, and a permitting/restricting portion, wherein the permitting/restricting portion is arranged to permit the clip terminal to be attached to one of the first housing and the second hosing when the insert portion is positioned at a predetermined position in the first housing, and restrict the clip terminal from being attached to one of the first housing and the second housing when the insert portion is not positioned at a predetermined position in the first housing.

The present invention provides, in a second aspect, the terminal connection structure according to the first aspect, wherein the clip terminal includes a pair of contact pieces arranged to sandwich the electric-contact portion of the first terminal fixture and the electric-contact portion of the second terminal fixture overlapped each other, and a biasing joint portion formed continuously from the pair of contact pieces, the biasing joint being arranged to bias the pair of contact pieces towards each other while the pair of contact pieces sandwiching the electric-contact portion of the first terminal fixture and the electric-contact portion of the second terminal fixture.

The present invention provides, in a third aspect, the terminal connection structure according to the second aspect further including a clip terminal holder arranged to cover the clip terminal and having an engagement portion arranged to engage with one of the first housing and the second housing.

According to the terminal connection structure of the first aspect of the present invention, the terminal connection structure is arranged so that the clip terminal is incapable of being attached to one of the first housing and the second housing when the insert portion of the second housing is not positioned at the predetermined position in the first housing. Thus, by attaching the clip terminal to one of the first housing and the second housing, the relative position of the electric-contact portion of the first terminal fixture and the electric-contact portion of the second terminal fixture can be set at the predetermined position.

Furthermore, the clip terminal is moved towards the electric-contact portions of the first and the second terminal fixtures along the direction intersecting the longitudinal direction of the electric-contact portions of the first and the second terminal fixtures, thereby connecting the electric-contact portions of the first and the second terminal fixtures. Thus, even if the electric-contact portions of the first and the second terminal fixtures are arranged in parallel with an interval between each other, the electric-contact portions of the first and the second terminal fixtures can be connected to each other in a reliable manner.

According to the terminal connection structure of the second aspect of the present invention, the clip terminal includes the pair of contact pieces and the biasing joint portion arranged to bias the pair of contact pieces towards each other. Thus, by sandwiching the electric-contact portions overlapped each other between the pair of contact pieces, the first terminal fixture and the second terminal fixture can be electrically-connected to each other in a reliable manner.

According to the terminal connection structure of the third aspect of the present invention, the terminal connection structure includes the clip terminal holder arranged to cover the clip terminal and having the engagement portion arranged to engage with one of the first housing and the second housing. Thus, the clip terminal holder can prevent the clip terminal from coming off.

Advantageous Effects of Invention

As explained above, the present invention according to the first aspect can set the relative position of the electric-contact portion of the first terminal fixture and the electric-contact portion of the second terminal fixture at the predetermined position. Thus, the terminal fixtures can be easily connected to each other without producing the variation in the electric resistance between the terminal fixtures.

Furthermore, the terminal fixtures can be connected to each other in a reliable manner even if the first terminal fixture and the second terminal fixture are arranged in parallel with an interval between each other. Thus, by arranging the first terminal fixture and the second terminal fixture in parallel with an interval between each other, the width of the terminal connection structure can be reduced compared to the case in which these terminal fixtures are arranged to lie in the same plane. Thus, the terminal connection structure can be downsized.

The present invention according to the second aspect can electrically-connect the first terminal fixture with the second terminal fixture in a reliable manner by sandwiching the terminal fixtures overlapped each other between the pair of contact pieces of the clip terminal. Thus, the terminal fixtures can be connected to each other in a reliable manner.

The present invention according to the third aspect can prevent the clip terminal from coming off with the clip terminal holder, thereby preventing the abrupt release of the connection of the terminal fixtures.

DESCRIPTION OF EMBODIMENTS

Figure 1:
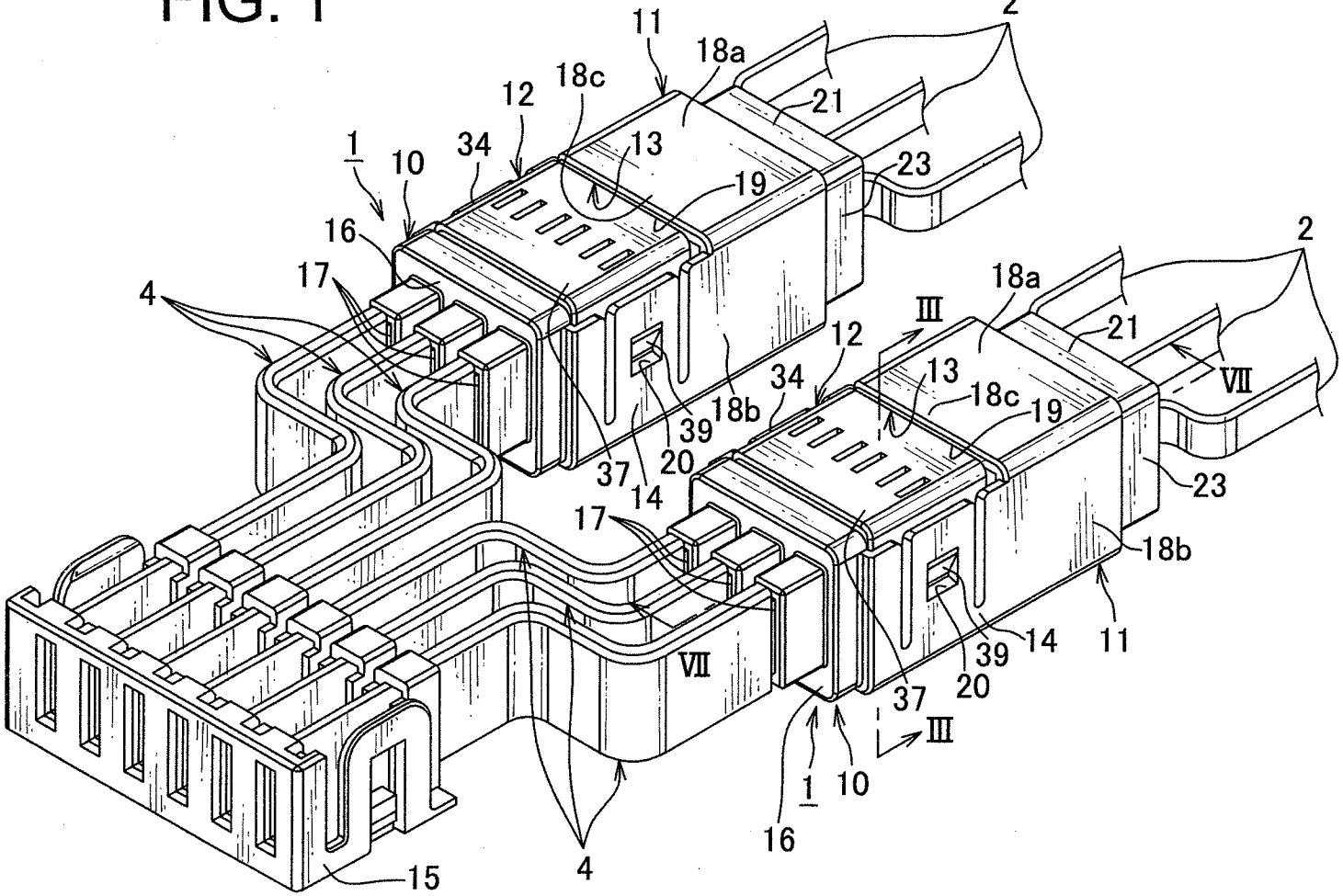
FIG. 1 is a perspective view of a terminal connection structure according to one embodiment of the present invention.
Figure 2:
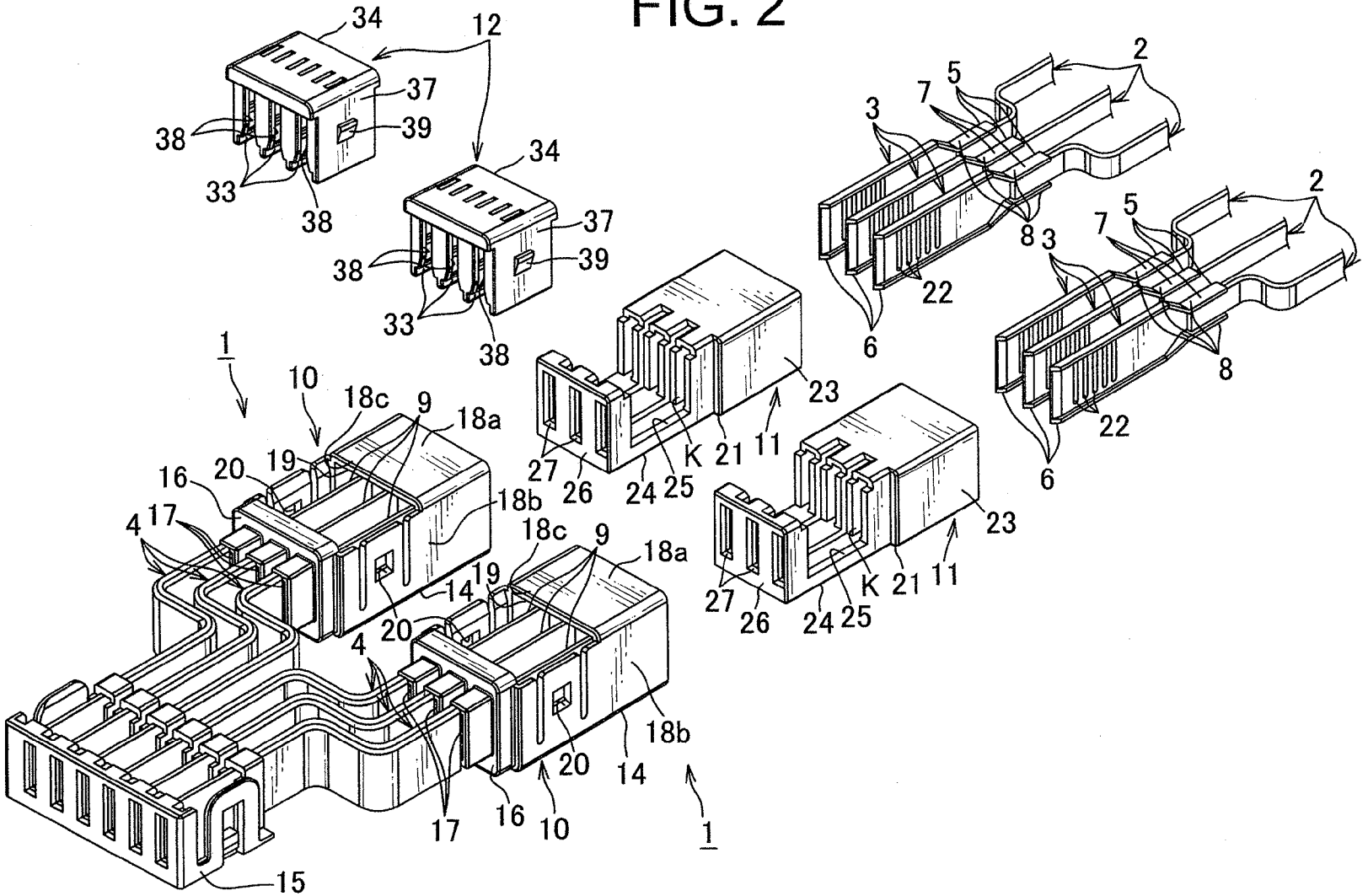
FIG. 2 is an exploded perspective view of the terminal connection structure shown in FIG. 1.

In the following, a terminal connection structure according to one embodiment of the present invention is explained in reference to FIGS. 1 through 12. As shown in FIGS. 1 and 2, a terminal connection structure 1 according to this embodiment is a terminal connection structure arranged to connect a thin-walled portion 9 as an electric-contact portion of a bus bar 4 as a first terminal fixture connected to an inverter as a power source device with an electric-contact portion 6 of a second terminal fixture 3 connected to a coil 2 of a motor as an another power source device. In the present invention, the power source is a device such as a battery, an inverter, a motor and a generator to which voltage for driving an automobile is applied.

The terminal connection structure 1 is a structure for connecting three bus bars 4 and three second terminal fixtures 3 together. The terminal connection structure 1 is arranged to connect the bus bar 4 and the second terminal fixture 3 to each other in one-to-one fashion. In the shown example, there are provided two terminal connection structures 1.

As shown in FIGS. 1 and 2, each of the terminal connection structures 1 includes a first connector 10, a second connector 11, a clip connector 12 and a permitting/restricting portion 13.

The first connector 10 includes the bus bar 4 as the first terminal fixture and a first housing 14. The bus bar 4 is made of conductive metal. As shown in FIG. 2, the bus bar 4 is formed into a strip-like shape which is bent at an angle of 90 degrees at two locations. In the shown example, there are provided three bus bars 4. At one end of the bus bar 4 there is provided the thin-walled portion 9 as an electric-contact portion which is thinner than the other portions. Furthermore, there is provided a connector housing 15 attached to the other end of the bus bar 4 for connection with the inverter as the power source device described above.

The bus bar 4 is made of aluminum alloy which is more flexible than metals (materials) such as copper and copper alloy forming the second terminal fixture 3 and thus is provided with flexibility. The plurality of bus bars 4 is arranged in parallel with an interval between each other. That is, the plurality of bus bars 4 is arranged such that surfaces of the thin-walled portions 9 are arranged in parallel at intervals with respect to each other.

The first housing 14 is made of insulating synthetic resin. The first housing 14 is formed into a rectangular tube-like shape with an opening located at one end of the housing 14 on the front side in FIG. 2 being blocked by a blocking wall 16. There is provided a through-hole 17 penetrating through the blocking wall 16 and being arranged to allow the thick-walled portion 9 provided at the one end of the bus bar 4 to pass therethrough but prohibit the other portions of the bus bar 4 from passing therethrough. The first housing 14 is arranged to receive the thin-walled portions 9 of the bus bars 4 inside of the first housing 14.

The first housing 14 includes a wall 18*a* located on the upper side in FIG. 2 and a cut-out portion 19 formed at an end of the wall 18*a* distant from the second connector 11, the cut-out portion 19 being formed by cutting out the wall 18*a* so as to allow inside and outside of the first housing 14 to communicate with each other. Furthermore, there are provided engagement holes 20 formed respectively on two side walls 18*b* of the first housing 14 which are formed continuously from the wall 18*a* having the cut-out portion 19. The engagement holes 20 are arranged to penetrate through the side walls 18*b* and are aligned with the cut-out portion 19 and in the width direction of the first housing 14 of the first connector 10.

The first connector 10 having the above-described structure is assembled by receiving the thin-walled portions 9 of the bus bars 4 in the first housing 14 through the through-holes 17.

The second connector 11 includes the second terminal fixture 3 and a second housing 21. The second terminal fixture 3 is made of conductive metal such as copper and copper alloy. As shown in FIG. 2, the second terminal fixture 3 is integrally provided with a gutter-shaped coil connection portion 5 and a strip-shaped electric-contact portion 6. The coil connection portion 5 is integrally formed into a gutter-like shape with a bottom-plate portion 7 and a pair of side plate portions 8 extending perpendicularly from both widthwise edges of the bottom-plate portion 7.

The coil 2 described above is attached to the coil connection portion 5 by placing the coil 2 on the bottom-plate portion 7 in an overlapping fashion. Both surfaces of the electric-contact portion 6 are arranged in plane with both surfaces of the bottom-plate portion 7 of the coil connection portion 5. In the shown example, there are provided three second terminal fixtures 3. Furthermore, the plurality of second terminal fixtures 3 is arranged in parallel with an interval between each other. In other words, the plurality of second terminal fixtures 3 is arranged such that surfaces of the electric-contact portions 6 are arranged in parallel at intervals with respect to each other.

There is provided a projection 22 formed on the surface of the electric-contact portion 6 of the second terminal fixture 3 so as to project towards the thin-walled portion 9 of the bus bar 4. The plurality of projections 22 is arranged along the longitudinal direction of the electric-contact portion 6 at an interval and is extending linearly in a direction perpendicular to (i.e. intersecting) the longitudinal direction of the electric-contact portion 6.

The second housing 21 is made of synthetic resin and is integrally provided with a tubular portion 23 and an insert portion 24 connected in series to each other. The tubular portion 23 is formed into a rectangular-tube shape and is arranged to receive inside of the tubular potion 23 the coil connection portions 5 of the three second terminal fixtures 3 as well as ends of the electric-contact portions 6 located adjacent to the coil connection portions 5. The insert portion 24 includes an entry wall 25 continued from one wall of the tubular portion 23 located on the lower side in FIG. 2 and an extending wall 26 extending perpendicularly from an edge of the entry wall 25. The extending wall 26 includes a through-hole 27 penetrating through the extending wall 26 and arranged to pass therethrough the thin-wall portion 9 as the electric-contact portion of the bus bar 4.

Figure 3:
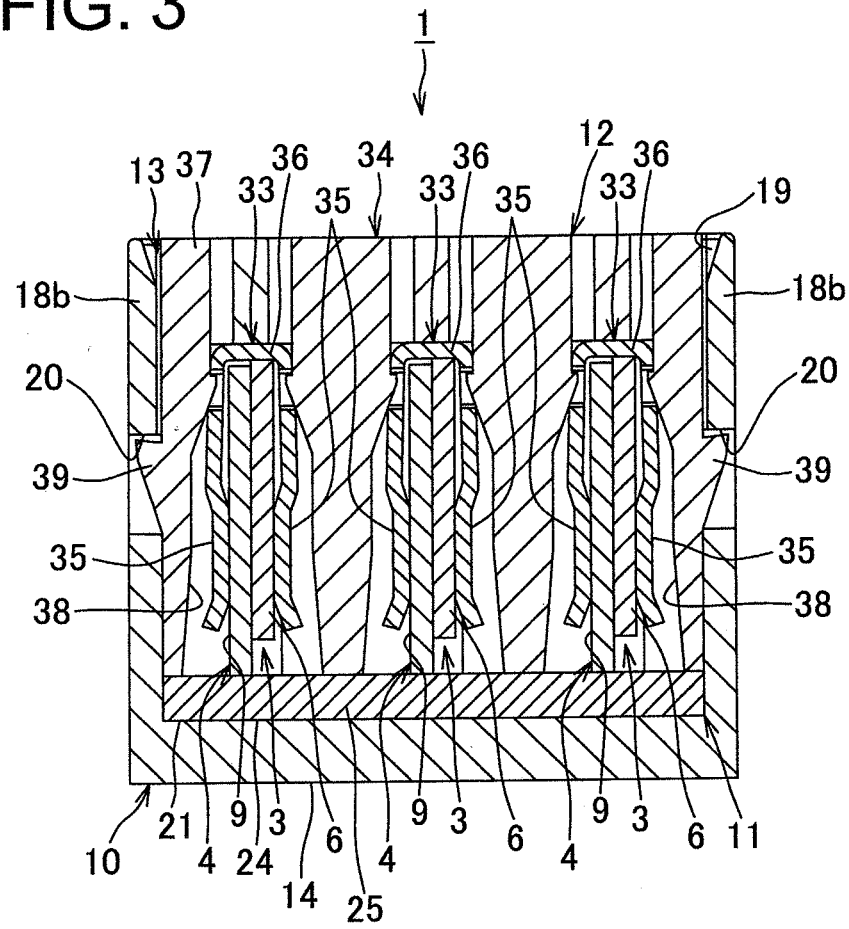
FIG. 3 is a cross-sectional view taken along a line shown in FIG. 1.
Figure 7:
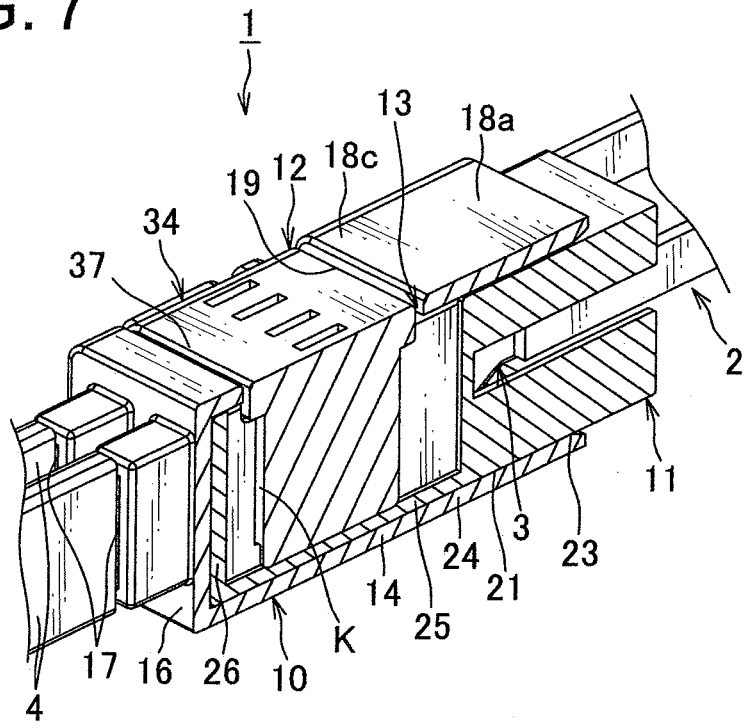
FIG. 7 is a perspective view of a cross-section taken along a line VII-VII shown in FIG. 1.
Figure 8:
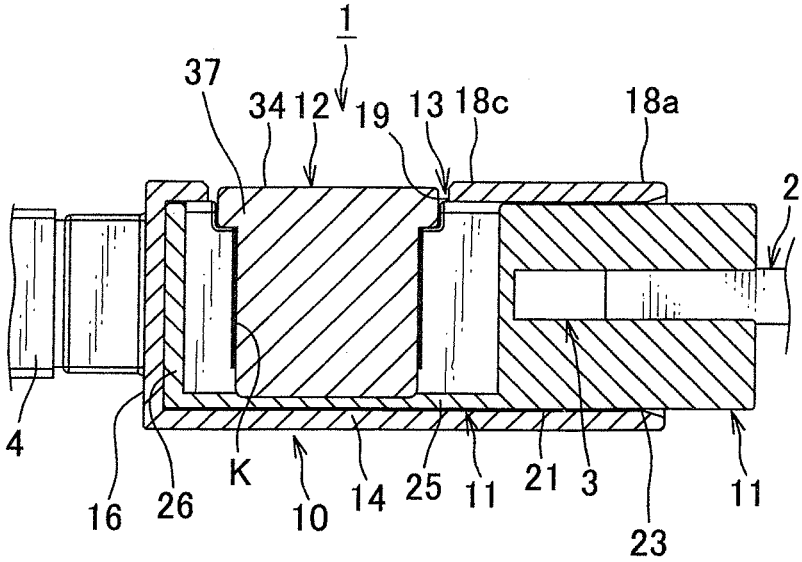
FIG. 8 is a cross-sectional view shown in FIG. 7.

The second connector 11 is assembled by receiving the second terminal fixtures 3 inside of the second housing 21. Then, the insert portion 24 of the second connector 11 is inserted into the first housing 14 of the first connector 10. By doing so, the thin-walled portions 9 of the bus bars 4 are inserted into the insert portion 24 of the second housing 21 of the second connector 11 through the through-holes 27 provided on the extending wall 26, as shown in FIG. 3, and the extending wall 26 is placed closely on the blocking wall 16 in an overlapping fashion, as shown in FIGS. 7 and 8. As a result, the cut-out portion 19 of the first housing 14 of the first connector 10 and a space K between the tubular portion 23 and the extending wall 26 of the second housing 21 of the second connector 11 are entirely communicated with each other.

Figure 9:
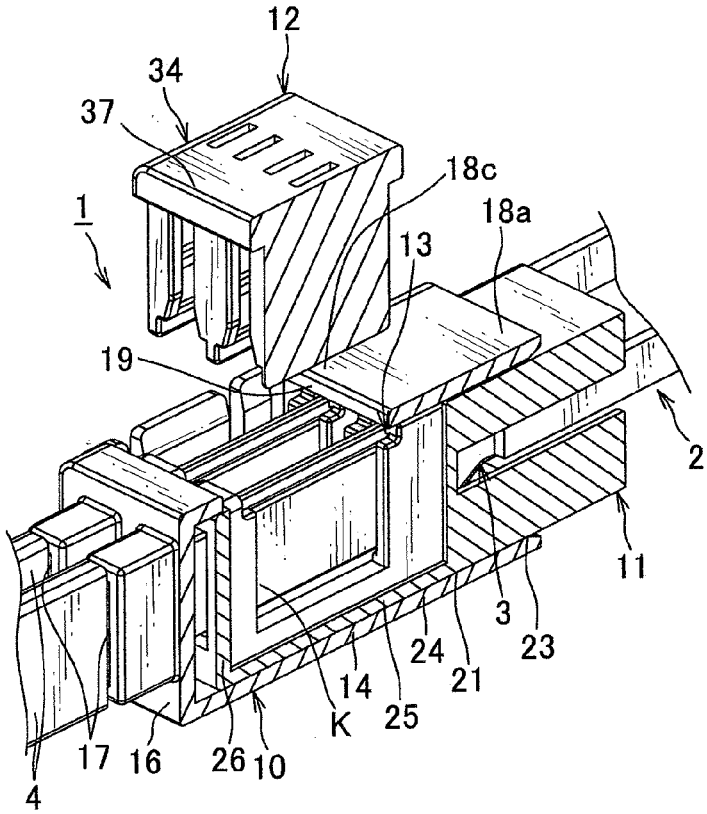
FIG. 9 is a perspective view showing a cross-section taken along a line IX-IX shown in FIG. 6.
Figure 10:
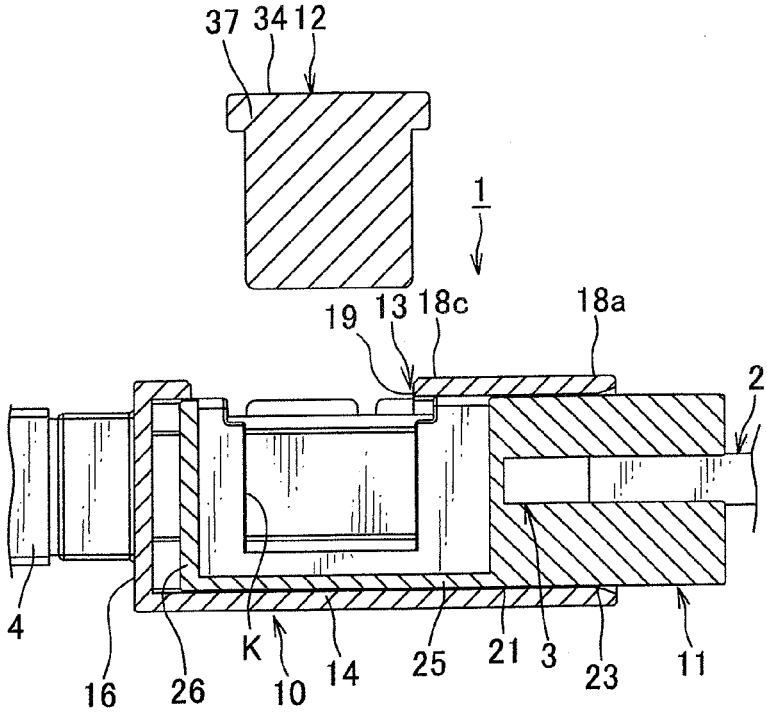
FIG. 10 is a cross-sectional view shown in FIG. 9.

Here, in the state in which a space is existing between the blocking wall 16 and the extending wall 26, as shown in FIGS. 9 and 10, the cut-out portion 19 of the first housing 14 of the first connector 10 and the space K between the tubular portion 23 and the extending wall 26 of the second housing 21 of the second connector 11 are not entirely communicated with each other. Instead, the space K between the tubular portion 23 and the extending wall 26 of the second housing 21 of the second connector 11 is partially hidden by an edge 18*c* of the cut-out portion 19 of the wall 18*a* of the first housing 14 of the first connector 10. Herein, the state in which the cut-out portion 19 of the first housing 14 of the first connector 10 and the space K between the tubular portion 23 and the extending wall 26 of the second housing 21 of the second connector 11 are entirely communicated with each other is called as a state in which the insert portion 24 is positioned at a predetermined position in the first housing 14 of the first connector 10.

Figure 4A:
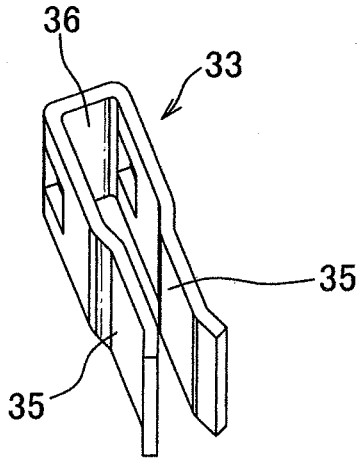
FIGS. 4A and 4B are perspective views of a clip terminal of the terminal connection structure shown in FIG. 1.
Figure 4B:
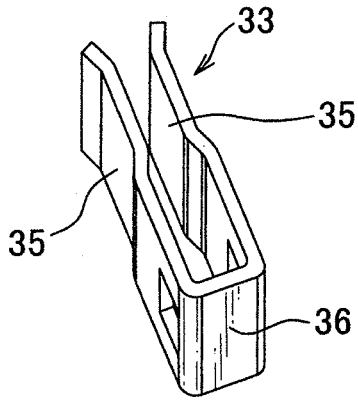

In the shown example, there is provided one clip connector 12. As shown in FIG. 3, the clip connector 12 includes a clip terminal 33 and a clip terminal holder 34. The clip terminal 33 is made of conductive metal. As shown in FIGS. 4A and 4B, the clip terminal 33 is integrally provided with a pair of contact pieces 35 formed in substantially flat-plate shape and arranged in parallel at an interval between each other and a biasing joint portion 36 continued from the respective contact pieces 35.

As shown in FIG. 3, the clip terminal 33 is arranged to sandwich the thin-walled portion 9 of the bus bar 4 and the electric-contact portion 6 of the second terminal fixture 3 overlapped each other between the pair of contact pieces 35. Once the thin-walled portion 9 of the bus bar 4 and the electric-contact portions 6 of the second terminal fixture 3 are sandwiched between the pair of contact pieces 35, the biasing joint portion 36 exerts an elastic restoring force which biases the pair of contact pieces 35 sandwiching the thin-walled portion 9 and the electric-contact portion 6 towards each other.

The clip terminal holder 34 is made of insulating synthetic resin. As shown in FIG. 3, the clip terminal holder 34 includes a holder body 37 formed into a rectangular parallelepiped-like shape, a terminal receiving space 38 provided inside of the holder body 37, and engagement projections 39 as a pair of engagement portions. The terminal receiving space 38 is provided at the holder body 37, is a space opened at an end face of the holder body 37 on the lower side in FIG. 3, and is arranged in parallel with an interval between each other. The terminal receiving space 38 is arranged to receive the clip terminal 33 thereinside. The engagement projection 39 is a projection projecting from an outer face of the holder body 37 and is arranged to engage in the engagement hole 20 to attach the clip terminal holder 34, i.e. the clip connector 12, to the first housing 14 of the first connector 10.

The clip connector 12 having the structure described above is assembled by receiving the clip terminal 33 in the terminal receiving space 38 followed by covering the clip terminal 33 with the clip terminal holder 34. The clip connector 12 is then positioned in a state in which the clip terminal 33 is opposed to the cut-out portion 19 of the first housing 14 into which the insert portion 24 has entered, for example, in the direction perpendicular to (i.e. intersecting) the longitudinal direction of the thin-walled portion 9 of the bus bar 4 and the electric-contact portion 6 of the second terminal fixture 3. The clip connector 12 is then inserted into the cut-out portion 19 such that a tip of the contact piece 35 of the clip terminal 33 is moved toward the electric-contact portion 6 and the thin-walled portion 9 overlapped each other. Thus, the clip terminal 33 is moved toward the thin-walled portion 9 of the bus bar 4 and the electric-contact portion 6 of the second terminal fixture 3 along the direction perpendicular to (i.e. intersecting) the longitudinal direction of the thin-walled portion 9 of the bus bar 4 and the electric-contact portion 6 of the second terminal fixture 3 overlapped each other.

Then, as shown in FIG. 3, the clip terminal 33 sandwiches the thin-walled portion 9 of the bus bar 4 and the electric-contact portion 6 of the second terminal fixture 3 overlapped each other between the pair of contact pieces 35, and the cut-out portion 19 is covered by the clip terminal holder 34, and the engagement projections 41 are engaged with the engagement holes 20, thereby fixing the clip connector 12 to the connectors 10, 11. In such a manner as described above, the clip terminal 33 is attached to the first housing 14 of the first connector 10 via the engagement projections 41 of the clip terminal holder 34. When fixed to the connectors 10, 11, the clip terminal 12 is entered into the cut-out portion 19 and entered between the tubular portion 23 and the extending wall 26 of the second housing 21, thereby restricting the separation of the connectors 10, 11 with respect to each other.

The permitting/restricting portion 13 includes the cut-out portion 19 described above, the space K between the tubular portion 23 and the extending wall 26 of the second housing 21 of the second connector 11, and the edge 18*c* of the cut-out portion 19 of the wall 18*a* located on the first housing 14 of the first connector 10. When the insert portion 24 is positioned at a predetermined position in the first housing 14, the cut-out portion 19 and the space K between the tubular portion 23 and the extending portion 26 are entirely communicated with each other, and the clip connector 12, i.e. the clip terminal 33, enters into the cut-out portion 19 and into the space K, as shown in FIGS. 7 and 8. In such a manner described above, the permitting/restricting portion 13 permits the thin-walled portion 9 of the bus bar 4 and the electric-contact portion 6 of the second terminal fixture 3 to connect to each other, i.e. permits the clip terminal 33 to be attached to the first housing 14.

Figure 11:
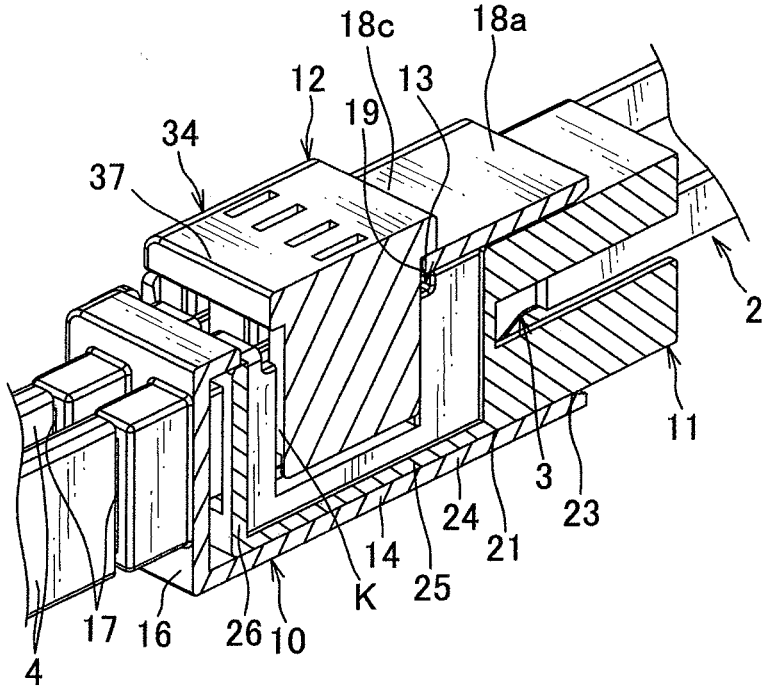
FIG. 11 is a perspective view showing a partial cross-section of the terminal connection structure shown in FIG. 1 in which the insert portion of the second connector is not positioned at a predetermined position in the first connector.
Figure 12:
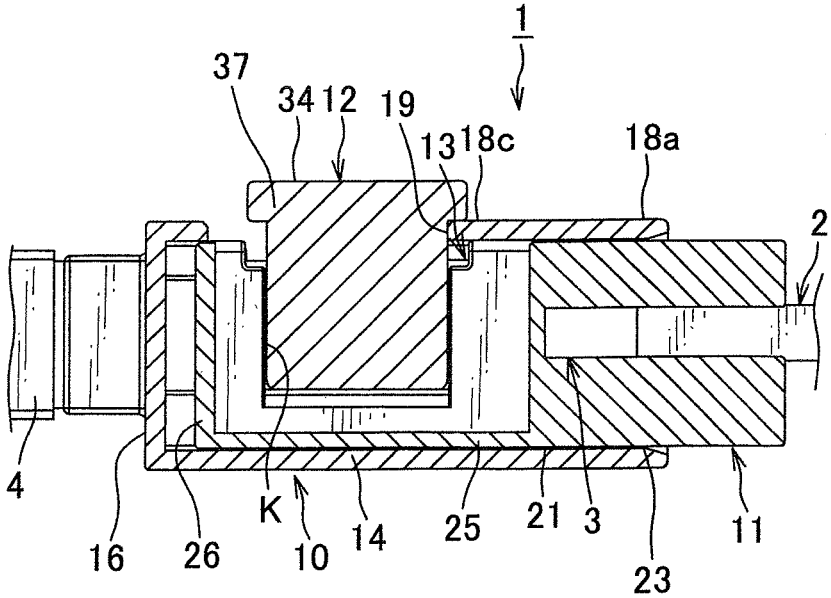
FIG. 12 is a cross-sectional view shown in FIG. 11.
Figure 13:
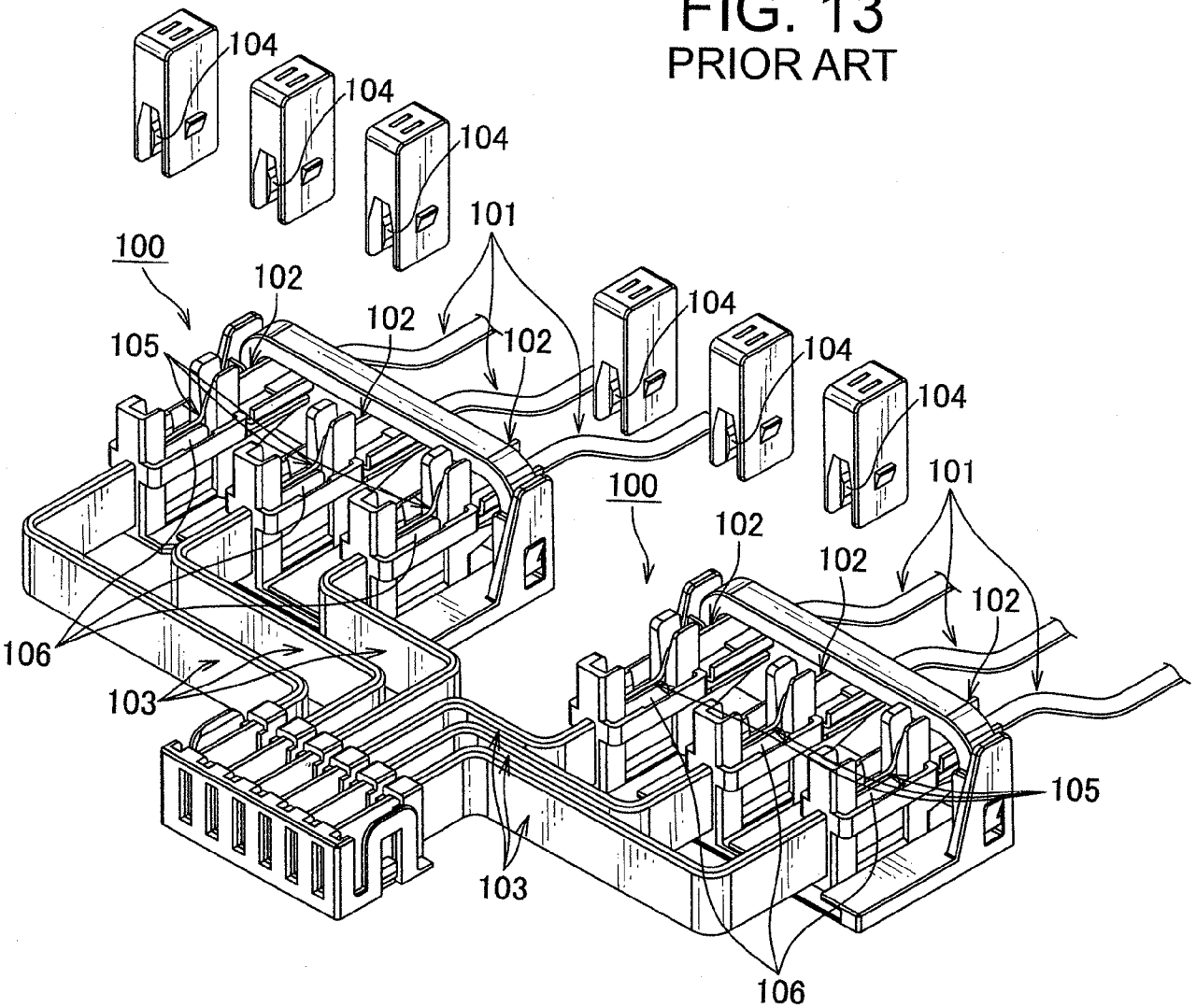
FIG. 13 PRIOR ART
FIG. 13 is an exploded perspective view of a terminal connection structure proposed by the same applicant as the present invention.

Furthermore, when the insert portion 24 is not positioned at a predetermined position in the first housing 14, in other words when the blocking wall 16 and the extending wall 26 are positioned with a space between each other, the cut-out portion 19 and the space K between the tubular portion 23 and the extending wall 26 do not entirely communicate with each other, as shown in FIGS. 9 and 10, but the clip terminal holder 34 of the clip connector 12 interferes with the edge of the cut-out portion 19 of the wall 18*a* of the first housing 14 of the first connector 10, as shown in FIGS. 11 and 12. In such a manner as described above, the permitting/restricting portion 13 restricts the engagement projections 41 from engaging with the engagement holes 20, i.e. restricts the clip terminal 33 from being attached to the first housing 14 of the first connector 10.

Figure 5:
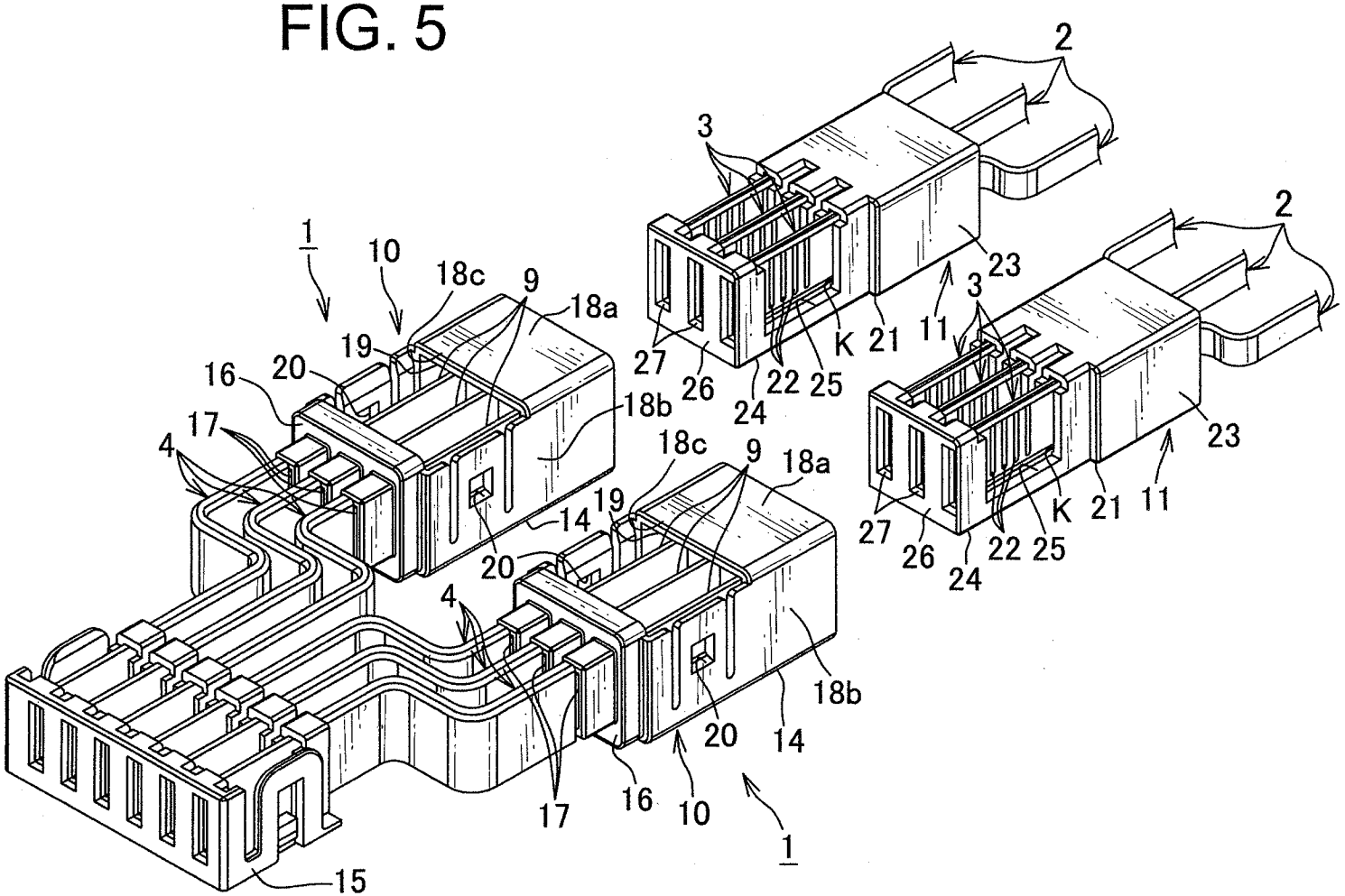
FIG. 5 is a perspective view of the terminal connection structure shown in FIG. 1 in which a first connector and a second connector are assembled.

The terminal connection structure 1 described above is assembled as explained below. Firstly, as shown in FIG. 5, the thin-walled portion 9 of the bus bar 4 is received in the first housing 14 to assemble the first connector 10, and the second terminal fixture 3 is received in the second housing 21 to assemble the second connector 11. Also, the connector housing 15 for connection with the inverter as another power source device described above is attached to the other end of the bus bar 4.

Figure 6:
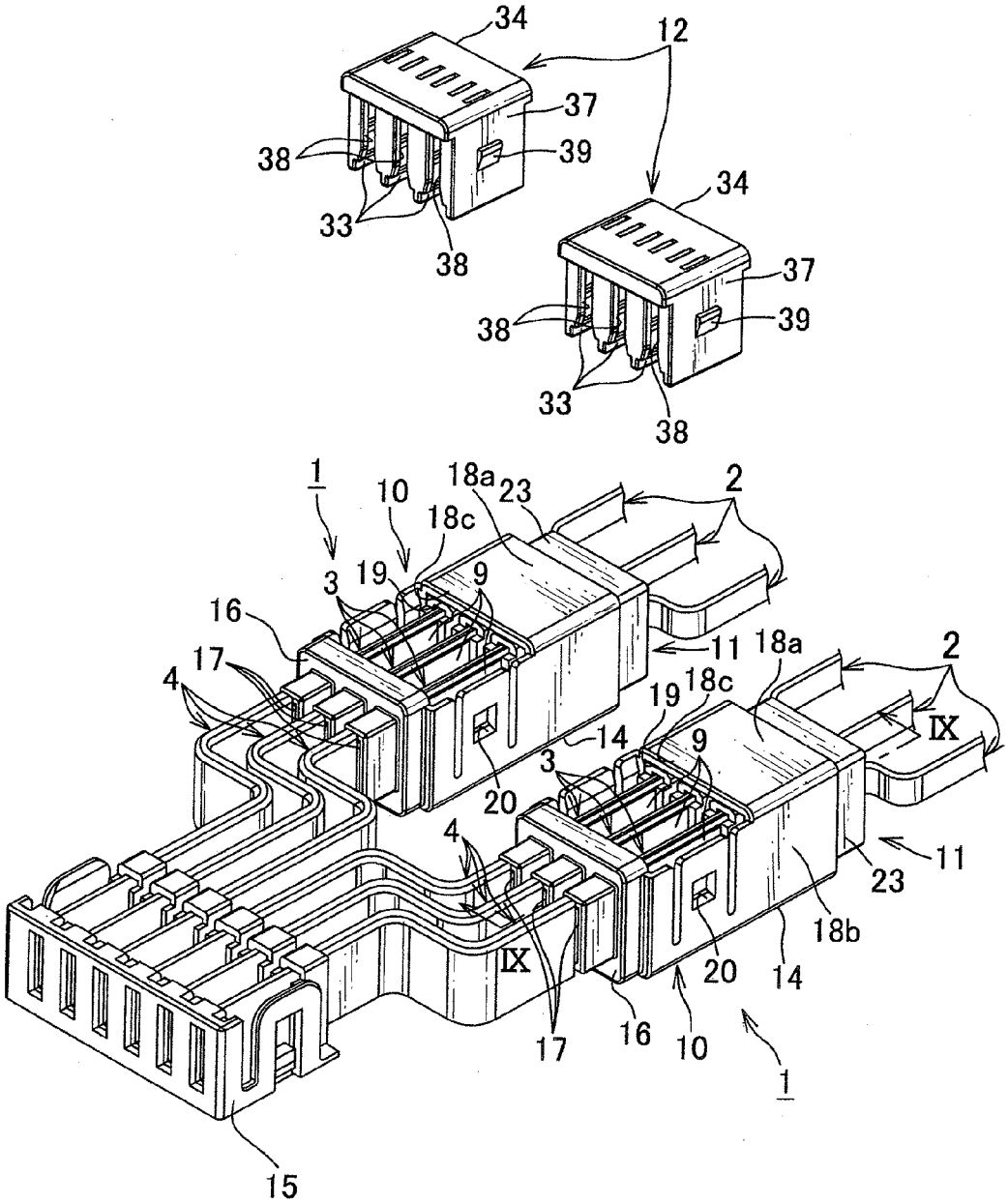
FIG. 6 is a perspective view of the terminal connection structure shown in FIG. 5 in which an insert portion of the second connector is inserted into the first connector.

Next, the first housing 14 of the first connector 10 and the insert portion 24 of the second connector 11 are positioned in an opposed position with a space between each other along the longitudinal direction of the thin-walled portion 9 of the bus bar 4 and the electric-contact portion 6 of the second terminal fixture 3, followed by inserting the insert portion 24 into the first housing 14, as shown in FIG. 6. Thus, the thin-walled portion 9 of the bus bar 4 enters into the second housing 21 of the second connector 11, and the thin-walled portion 9 of the bus bar 4 and the electric-contact portion 6 of the second terminal fixture 3 are overlapped each other, as well as the extending wall 26 is overlapped closely on the blocking wall 16, thereby positioning the insert portion 24 at the predetermined position with respect to the first housing 14.

Next, as shown in FIG. 6, the clip connector 12 is brought at a position opposing the cut-out portion 19 and the space K between the tubular portion 23 and the extending wall 26 along the direction perpendicular to (i.e. intersecting with) the longitudinal direction of the electric-contact portion 6 and the thin-walled portion 9 overlapped each other. Then, the clip connector 12 is inserted into the cut-out portion 19 and into the space K between the tubular portion 23 and the extending wall 26. By doing so, the engagement projections 39 are engaged with the engagement holes 20, and the clip connector 12 is attached to the first housing 14 of the first connector 10.

Of course, during this time, when inserting the clip connector 12 into the cut-out portion 19 and into the space K between the tubular portion 23 and the extending wall 26, the electric-contact portion 6 of the second terminal fixture 3 and the thin-walled portion 9 of the bus bar 4 are sandwiched between the pair of contact pieces 35 of the clip terminal 33. Thus, at this moment even if the electric-contact portion 6 of the second terminal fixture 3 and the thin-walled portion 9 of the bus bar 4 are spaced from each other due to the displacement of the coil 2 of the motor, the bus bar 4 is deformed as the electric-contact portion 6 and the thin-walled portion 9 are inserted between the contact pieces 35 of the clip terminal 33 by the elastic restoring force of the biasing joint portion 36 and by the moving attachment portion 13, so the electric-contact portion 6 and the thin-walled portion 9 are closely contacted with each other.

Thus, once the engagement projections 39 are engaged with the engagement holes 20, the thin-walled portion 9 of the bus bar 4 and the electric-contact portion 6 of the second terminal fixture 3 are closely overlapped each other due to the elastic restoring force of the biasing joint portion 36 of the clip terminal 33, as shown in FIG. 3. Thus, the terminal connection structure 1 described above is assembled in a manner as described above, and the bus bar 4 and the second terminal fixture 3 are connected to each other. Then, a bus bar and an attachment connector and such connected to the inverter as another power source device are attached to the connector housing 15 to connect the motor as the power source and the inverter as another power source device to each other. Furthermore, the terminal connection structure 1 assembled in a manner as described above is received in a case of the motor and such.

According to this embodiment, the clip terminals 33 cannot be attached to the first housing 14 if the insert portion 24 of the second housing 21 is not positioned at the predetermined position in the first housing 14. Thus, by attaching the clip terminals 33 to the first housing 14, the relative position of the thin-walled portion 9 of the bus bar 4 and the electric-contact portion 6 of the second terminal fixture 3 can be set at the predetermined position. Consequently, the bus bars 4 and the second terminal fixtures 3 can be easily connected to each other, while preventing the production of variation in electric resistance between the bus bars 4 and the second terminal fixtures 3.

The thin-walled portion 9 of the bus bar 4 and the electric-contact portion 6 of the second terminal fixture 3 are connected to each other by sandwiching the thin-walled portion 9 and the electric-contact portion 6 between the pair of contact pieces 35 of the clip terminal 33 which is moved towards the thin-walled portion 9 and the electric-contact portion 6 along the direction perpendicular to (i.e. intersecting) the longitudinal direction of the thin-walled portion 9 and the electric-contact portion 6 overlapped each other. Thus, even if the plurality of thin-walled portions 9 of the bus bars 4 and the plurality of electric-contact portions 6 of the second terminal fixtures 3 are respectively arranged in parallel with an interval between each other, the thin-walled portions 9 and the electric-contact portions 6 can be connected to each other in a reliable manner. Consequently, by respectively arranging the plurality of thin-walled portions 9 of the bus bars 4 and the plurality of electric-contact portions 6 of the second terminal fixtures 3 in parallel with an interval between each other, the width of the terminal connection structure 1 can be reduced compared to the case in which the plurality of thin-walled portions 9 and the plurality of electric-contact portions 6 are arranged to lie in the same plane. Thus, the terminal connection structure 1 can be downsized.

Furthermore, the clip terminal 33 includes the pair of contact pieces 35 and the biasing joint portion 36 arranged to bias the pair of contact pieces 35 towards each other. Thus, the second terminal fixture 3 and the bus bar 4 can be electrically-contacted with each other in a reliable manner by sandwiching the electric-contact portion 6 and the thin-walled portion 9 overlapped each other between the pair of contact pieces 35. Moreover, the thin-walled portion 9 as the electric-contact portion of the bus bar 4 is made of the aluminum alloy which is more flexible than the material constituting the electric-contact portion 6 of the first terminal fixture 3, and the electric-contact portion 6 is provided with the projection portion 22. Thus, when the clip terminal 33 biases the thin-walled portion 9 and the electric-contact portion 6 to closely contact each other, the projections 22 will dig firmly into the thin-walled portion 9 of the bus bar 4, thereby making the thin-walled portion 9 and the electric-contact portion 6 to closely contact each other even more reliably. Thus, the bus bar 4 and the second terminal fixture 3 can be connected to each other in a reliable manner.

Furthermore, since the clip connector 12 is provided with the clip terminal holder 34 arranged to cover the clip terminal 33, the clip terminal holder 34 can prevent the clip terminal 33 from coming off. Thus, the connection between the second terminal fixture 3 and the bus bar 4 can be prevented from being released abruptly.

The clip terminal 33 is attached to the first housing 14 of the first connector 10 via the clip terminal holder 34 by engaging the engagement projections 41 with the engagement holes 20. However, in the present invention, the clip terminal 33 may be directly or indirectly attached to the second housing 21 of the second connector 11. Alternatively, in the present invention, the clip terminal holder 34 may be eliminated.

The embodiments described above are only representative embodiments of the present invention, and the present invention is not limited to these embodiments. That is, the embodiments can be modified and performed in various ways without departing from the scope of the present invention.

REFERENCE SIGN LIST

1 terminal connection structure
3 second terminal fixture
4 bus bar (first terminal fixture)
6 electric-contact portion
9 thin-walled portion (electric-contact portion)
13 permitting/restricting portion
14 first housing
21 second housing
24 insert portion
33 clip terminal
34 clip terminal holder
35 contact piece
36 biasing joint portion
39 engagement projection (engagement portion)

The invention claimed is:

1. A terminal connection structure for connecting an electric-contact portion of a first terminal fixture connected to a power source device with an electric-contact portion of a second terminal fixture connected to another power source device, the terminal connection structure comprising, a first housing arranged to receive the electric-contact portion of the first terminal fixture, a second housing arranged to receive the electric-contact portion of the second terminal fixture and having an insert portion to be inserted into the first housing, a clip terminal which is moved towards the second housing with the insert portion being inserted into the first housing along a direction intersecting the electric-contact portion of the first terminal fixture and the electric-contact portion of the second terminal fixture overlapped each other, by which the clip terminal is attached to one of the first housing and the second housing while the electric-contact portion of the first terminal fixture and the electric-contact portion of the second terminal fixture being closely contacted to each other, and a permitting/restricting portion arranged to permit the clip terminal to be attached to one of the first housing and the second hosing when the insert portion is positioned at a predetermined position in the first housing and restrict the clip terminal from being attached to one of the first housing and the second hosing when the insert portion is not positioned at a predetermined position in the first housing.

2. The terminal connection structure according to claim 1, wherein the clip terminal includes a pair of contact pieces arranged to sandwich the electric-contact portion of the first terminal fixture and the electric-contact portion of the second terminal fixture overlapped each other, and a biasing joint portion formed continuously from the pair of contact pieces, the biasing joint being arranged to bias the pair of contact pieces towards each other while the pair of contact pieces sandwiching the electric-contact portion of the first terminal fixture and the electric-contact portion of the second terminal fixture.

3. The terminal connection structure according to claim 2 further comprising a clip terminal holder arranged to cover the clip terminal and having an engagement portion arranged to engage with one of the first housing and the second housing.

* * * * *